US010358625B2

(12) United States Patent
Goncalves Rodrigues

(10) Patent No.: US 10,358,625 B2
(45) Date of Patent: Jul. 23, 2019

(54) NON-CORROSIVE CLEANING COMPOSITION

(71) Applicant: S.C. Johnson & Son, Inc., Racine, WI (US)

(72) Inventor: Juan Jose Goncalves Rodrigues, Oak Creek, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 70 days.

(21) Appl. No.: 15/171,541

(22) Filed: Jun. 2, 2016

(65) Prior Publication Data

US 2017/0015958 A1 Jan. 19, 2017

Related U.S. Application Data

(60) Provisional application No. 62/193,984, filed on Jul. 17, 2015.

(51) Int. Cl.
*C11D 17/00* (2006.01)
*C11D 11/00* (2006.01)
(Continued)

(52) U.S. Cl.
CPC ..... *C11D 17/003* (2013.01); *C11D 1/008* (2013.01); *C11D 1/722* (2013.01); *C11D 1/8255* (2013.01);
(Continued)

(58) Field of Classification Search
CPC .. C11D 1/02; C11D 1/72; C11D 1/722; C11D 1/83; C11D 1/88; C11D 3/2041;
(Continued)

(56) References Cited

U.S. PATENT DOCUMENTS 3,578,499 A 5/1971 Crotty et al.
3,681,141 A 8/1972 Muoio
(Continued)

FOREIGN PATENT DOCUMENTS

AU 81384-91 11/1991
DE 1924332 11/1970
(Continued)

OTHER PUBLICATIONS

Lubrizol, "Dispersion Techniques for Carbopol Polymers", Technical Data Sheet, p. 1-5, Oct. 2007.*
International Search Report and Written Opinion regarding corresponding PCT International Application No. PCT/US2016/037489, dated Oct. 17, 2016, 14 pages.
Abstract of JP A-6-141797 (1985).

* cited by examiner

*Primary Examiner* — Gregory R Delcotto

(57) ABSTRACT

A cleaning composition, which is self-adhering upon application to a hard surface, is provided. The cleaning composition includes an adhesion promoter, water and a sufficient amount of a basic agent, such that a mixture of the composition with deionized water has a pH of at least about 10. The adhesion promoter typically includes one or more organic compounds, each containing at least one hydrophilic group. The cleaning compositions may also include at least one surfactant selected from the group of: anionic, nonionic, cationic, amphoteric, and/or zwitterionic surfactants; where one or more of the surfactants may serve all or in part as the adhesion promoter.

45 Claims, 4 Drawing Sheets

(51) Int. Cl.

| | |
|---|---|
| ***C11D 3/20*** | (2006.01) |
| ***C11D 3/30*** | (2006.01) |
| ***C11D 3/04*** | (2006.01) |
| ***C11D 3/37*** | (2006.01) |
| ***C11D 1/722*** | (2006.01) |
| ***C11D 3/50*** | (2006.01) |
| ***C11D 1/83*** | (2006.01) |
| ***C11D 1/88*** | (2006.01) |
| ***C11D 1/00*** | (2006.01) |
| ***C11D 1/825*** | (2006.01) |
| ***C11D 3/22*** | (2006.01) |
| *C11D 1/72* | (2006.01) |

(52) U.S. Cl.

CPC ..... *C11D 1/83* (2013.01); *C11D 1/88* (2013.01); *C11D 3/044* (2013.01); *C11D 3/2041* (2013.01); *C11D 3/2065* (2013.01); *C11D 3/2068* (2013.01); *C11D 3/222* (2013.01); *C11D 3/30* (2013.01); *C11D 3/3707* (2013.01); *C11D 3/3723* (2013.01); *C11D 3/3757* (2013.01); *C11D 3/50* (2013.01); *C11D 11/0023* (2013.01); *C11D 17/0043* (2013.01); *C11D 1/72* (2013.01); *C11D 11/0058* (2013.01)

(58) Field of Classification Search

CPC ..... C11D 3/2065; C11D 3/30; C11D 3/3757; C11D 3/3723; C11D 3/50

USPC ..... 510/191, 238, 421, 422, 423, 475, 499, 510/505, 506

See application file for complete search history.

(56) References Cited

U.S. PATENT DOCUMENTS 3,955,986 A 5/1976 Miller
4,240,921 A 12/1980 Kaniecki
4,491,538 A * 1/1985 McCoy ..... B01F 17/0042 510/232
4,556,504 A 3/1985 Rek
4,578,207 A 3/1986 Holdt et al.
4,911,858 A 3/1990 Bunczk et al.
5,047,167 A 9/1991 Steyn et al.
5,059,414 A * 10/1991 Dallal ..... A61K 8/03 424/401
5,098,596 A * 3/1992 Balzer ..... A61K 8/39 510/119
5,100,573 A * 3/1992 Balzer ..... A61K 8/39 510/119
5,254,290 A 10/1993 Blandizux et al.
5,336,427 A 8/1994 Bunczk et al.
5,460,742 A 10/1995 Cavanagh et al.
5,466,395 A 11/1995 Tosaka et al.
5,472,629 A 12/1995 Lysy et al.
5,559,091 A 9/1996 Geboes et al.
5,562,850 A 10/1996 Woo et al.
5,579,842 A 12/1996 Riley
5,591,376 A 1/1997 Kiewert et al.
5,679,629 A 10/1997 Kubota et al.
5,767,056 A 6/1998 Lenoir
5,849,310 A 12/1998 Trinh et al.
5,877,135 A 3/1999 Hahn
5,985,808 A 11/1999 He et al.
6,087,309 A 7/2000 Vinson et al.
6,100,227 A 8/2000 Burlew
6,150,315 A 11/2000 Komocki et al.
6,153,571 A 11/2000 Komocki et al.
6,194,363 B1 * 2/2001 Murray ..... A61K 8/731 424/70.12
6,277,361 B1 * 8/2001 Murray ..... A61K 8/898 424/70.1
6,294,159 B1 * 9/2001 Reich ..... A61K 8/585 424/70.1
6,336,977 B1 1/2002 Menke et al.
6,355,234 B1 * 3/2002 Birtwistle ..... A61K 8/442 424/70.1
6,407,051 B1 6/2002 Smith et al.
6,433,053 B1 8/2002 Kasturi et al.
6,482,793 B1 * 11/2002 Gordon ..... C11D 1/8255 134/25.2
6,491,933 B2 12/2002 Lorenzi et al.
6,617,292 B2 * 9/2003 Perron ..... A61K 8/0241 510/119
6,664,218 B1 * 12/2003 Dastbaz ..... C11D 1/90 510/180
6,667,286 B1 12/2003 Dettinger et al.
6,838,426 B1 1/2005 Zeilinger
6,914,075 B2 7/2005 Nakano et al.
7,018,970 B2 3/2006 Hsu et al.
7,709,433 B2 5/2010 Veltman et al.
7,727,948 B2 6/2010 Mock-Knoblauch et al.
7,776,811 B2 8/2010 Dilley et al.
7,919,447 B1 4/2011 Klinkhammer et al.
8,062,381 B2 11/2011 Shamayeli et al.
8,143,205 B2 3/2012 Klinkhammer et al.
8,143,206 B2 3/2012 Klinkhammer et al.
8,198,227 B2 * 6/2012 Cermenati ..... C11D 3/2082 510/238
8,329,630 B2 12/2012 Finison et al.
8,349,301 B2 * 1/2013 Wells ..... A61K 8/0295 424/70.19
8,361,449 B2 * 1/2013 Wells ..... A61K 8/0295 424/70.19
8,420,586 B2 4/2013 Vinson et al.
8,440,600 B2 5/2013 Klinkhammer et al.
8,444,771 B2 5/2013 Leipold et al.
8,454,709 B2 * 6/2013 Man ..... C11D 1/37 134/25.2
8,461,093 B2 6/2013 Leipold et al.
8,597,668 B2 * 12/2013 Nguyen ..... A61K 8/361 424/401
8,629,092 B2 * 1/2014 Woo ..... A61L 9/01 510/101
8,658,588 B2 * 2/2014 Wortley ..... C11D 1/66 510/403
8,669,218 B2 3/2014 Schiedel et al.
8,772,216 B2 7/2014 Volont et al.
8,835,371 B2 9/2014 Leipold et al.
8,845,758 B2 9/2014 Neuba et al.
8,927,477 B2 1/2015 Pagani
8,980,813 B2 3/2015 Klinkhammer et al.
8,993,502 B2 3/2015 Klinkhammer et al.
9,102,906 B2 8/2015 Leipold et al.
9,187,720 B2 11/2015 Leipold et al.
9,637,902 B2 5/2017 Burt et al.
9,644,359 B2 5/2017 Burt et al.
9,662,413 B2 5/2017 Hurry et al.
2003/0083210 A1 5/2003 Goldberg et al.
2003/0125220 A1 7/2003 Dykstra et al.
2004/0221870 A1 11/2004 Canoiranzo et al.
2005/0020466 A1 * 1/2005 Man ..... C11D 3/046 510/392
2005/0054547 A1 * 3/2005 Ganopolsky ..... A61K 8/442 510/130
2005/0090422 A1 * 4/2005 Lukenbach ..... A61K 8/0295 510/417
2005/0129626 A1 6/2005 Koivisto et al.
2006/0111262 A1 5/2006 Conzelmann et al.
2006/0204526 A1 9/2006 Lathrop et al.
2008/0255017 A1 10/2008 Dettinger et al.
2009/0043130 A1 * 2/2009 Qiu ..... C07C 211/15 564/209
2009/0215661 A1 8/2009 Klinkhammer et al.
2009/0215909 A1 8/2009 Wortley et al.
2009/0301519 A1 * 12/2009 Aubay ..... A61K 8/0208 134/6
2009/0325839 A1 12/2009 Wortley et al.
2010/0093586 A1 4/2010 Klinkhammer et al.

(56) References Cited

U.S. PATENT DOCUMENTS

| | | | | |
|---|---|---|---|---|
| 2011/0053818 | A1* | 3/2011 | Chuchotiros | A61K 8/042 510/123 |
| 2011/0081392 | A1* | 4/2011 | de Arruda | A61K 8/0225 424/401 |
| 2012/0108490 | A1 | 5/2012 | Wortley et al. | |
| 2012/0213726 | A1* | 8/2012 | Green | C07C 6/04 424/70.24 |
| 2013/0040869 | A1* | 2/2013 | Cox | A61K 8/44 510/119 |
| 2013/0237470 | A1 | 9/2013 | Bockmuehl et al. | |
| 2014/0037569 | A1 | 2/2014 | Leipold et al. | |
| 2014/0248220 | A1 | 9/2014 | Abram et al. | |
| 2014/0298577 | A1 | 10/2014 | Burt et al. | |
| 2014/0356311 | A1 | 12/2014 | Leipold et al. | |
| 2015/0141251 | A1 | 5/2015 | Dawson et al. | |
| 2015/0141466 | A1* | 5/2015 | Klug | A61K 8/42 514/345 |
| 2015/0141508 | A1* | 5/2015 | Klug | A61K 8/41 514/547 |

FOREIGN PATENT DOCUMENTS

| | | | |
|---|---|---|---|
| EP | 0 631 788 | | 1/1995 |
| EP | 1978080 | A1 | 10/2008 |
| GB | 1531751 | | 11/1978 |
| GB | 2204321 | | 11/1988 |
| GB | 2 280 906 | | 2/1995 |
| GB | 2 288 186 | | 10/1995 |
| WO | WO-97/05232 | | 2/1997 |
| WO | WO-97/40133 | | 10/1997 |
| WO | WO 98/36047 | | 8/1998 |
| WO | WO-02/26925 | | 4/2002 |
| WO | WO-03/066797 | | 8/2003 |
| WO | WO 2014/058402 | | 4/2014 |
| WO | WO 2015/091678 | A1 | 6/2015 |

NON-CORROSIVE CLEANING COMPOSITION

CROSS-REFERENCE TO RELATED APPLICATIONS

This patent application claims the benefit of U.S. Provisional Patent Application 62/193,984, filed on Jul. 17, 2015; the entire contents of which are hereby incorporated by reference, for any and all purposes.

BACKGROUND

Aerosol systems that use a propellant gas to deliver highly viscous products, such as cheese or churro dough (food industry), and caulking materials, are known. Generally, in such applications, the product formulation and propellant gases are physically separated by a barrier, such as a bag. The propellant, which exists outside the bag, pushes on the bag after an aerosol actuator is acted upon to deliver the material contained inside the bag. Since the product being delivered is physically isolated from the aerosol can body and valve cup components, incompatibility or corrosion potential amongst the product and steel-like alloys is not a concern. While this technology (commonly known as bag-in-valve or bag-in-can) has become widely adopted for some products, these non-traditional aerosol components are substantially more expensive and cumbersome to handle in a production line than traditional aerosol dispensers. Thus, due to processing and cost considerations, such non-traditional aerosol systems are not considered to suitable for certain categories of products, such as bathroom cleaners. Another available alternative currently is the usage of aerosol cans made of inert metals and alloys, such as aluminum. Like bag based technologies, however, aluminum components are more expensive than traditional steel-based aerosol dispensers.

Unfortunately, the tin-plated steel cans that are typically used as dispensers for viscous aerosol materials will readily corrode if in contact with materials having the pH of typical toilet cleaning gels, e.g., a pH of about 4 to 6. While it is known that increasing the pH of a water containing formulation can reduce corrosion of steel in contact with the formulation, the effect of the addition of basic materials on the physical properties of a given formulation is unclear. The effects of such formulation changes by adding basic materials to cleaning gel materials to alter the pH, could lead to changes in gel rheology, the sensorial properties, delivery attributes, lastingness, surface adhesion and/or drying properties of the cleaning gels. If basic agents were to be added to a cleaning gel formulation to raise its pH, it should desirably be done in a manner that does not adversely affect other desirable properties of the gel, such as its rheology profile (e.g., gelling point, yield stress), surface adhesion characteristics, wettability, moisture retention, durability/dissolution profile in aqueous environments (e.g., after a number of toilet flushes) and fragrancing capabilities, amongst others.

SUMMARY

The present application relates generally to the field of cleaning compositions and, in particular, cleaning compositions which may be especially useful for cleaning hard surfaces, such as the inside surface of a toilet bowl. The present application provides cleaning compositions, which are typically self-adhering upon application to a hard surface, e.g., a vertical or inclined hard surface. The composition commonly is a gel, which may desirably be applied in aerosol form. The cleaning compositions include water, a basic agent (i.e., a compound which is capable of serving as a source of alkalinity in the composition), and an adhesion promoter, which typically includes one or more organic compounds, each containing at least one hydrophilic group. The cleaning compositions also include a sufficient amount of the basic agent such that water in contact with the composition has a pH of at least about 10, e.g., an equilibrated mixture of 10 wt. % of the composition with deionized water has a pH of at least about 10. Commonly, the cleaning compositions also include at least one surfactant selected from the group of: anionic, nonionic, cationic, amphoteric, and/or zwitterionic surfactants; where one or more of the surfactants may serve all or in part as the adhesion promoter.

In the present cleaning compositions, the adhesion promoter may include polysaccharide, hydrophilic synthetic polymer and/or an organic compound(s), which includes one or more one hydrophilic polyalkoxy groups. Suitable examples of organic compound(s), which contain one or more one hydrophilic polyalkoxy groups include polyethylene glycol, alkoxylated alcohols, alkoxylated polyol partial esters and polymeric alkylene oxide block copolymers. For example, the adhesion promoter may include ethoxylated alcohol(s), ethoxylated polyol partial ester(s), polyethylene glycol and/or ethyleneoxide-propyleneoxide block copolymer(s).

The present cleaning compositions desirably have a gel melt temperature of about 50-90° C., more commonly about 55-80° C. In some instances, the present cleaning gels may desirably have a gel melt temperature of about 60-70° C. Quite typically, the present cleaning compositions have a viscosity of at least about 150,000 mPs at 25° C. and, often, at least about 250,000-800,000 mPs at 25° C. In some embodiments, the present cleaning compositions may have a viscosity of no more than about 800,000 mPs at 25° C. In many embodiments the cleaning composition are in gel form having a viscosity of about 300,000-600,000 mPs at 25° C. Higher viscosity forms of the present cleaning compositions, e.g., those with viscosity of at least about 500,000 mPs at 25° C. and, often, about 600,000-800,000 mPs at 25° C., may desirably have a gel yield point at least about 2,500 Pa. In many embodiments the cleaning composition are in gel form having a gel yield point of about 2,500 to 4,500 Pa, and in some instances about 3,000 to 4,000 Pa.

In order to facilitate packaging aerosol forms of the present cleaning compositions in a container made from steel or other materials susceptible to corrosion it may be advantageous to formulate cleaning gels which have a basic pH. Accelerated electrochemical corrosion tests have demonstrated that the present cleaning compositions are suitable for long term contact with metals typically encountered in traditional aerosol components, e.g., tin plated steel containers. The present cleaning compositions desirably include a sufficient amount of the basic agent such that an equilibrated mixture of 10 wt. % of the cleaning composition with deionized water has a pH of at least about 10, at least about 10.5, and commonly about 10.5 to 12.

The basic agent included in the present cleaning compositions may include an amine compound and/or an inorganic basic material, such as an alkali metal hydroxide and/or alkaline earth hydroxide. Where the basic agent is an amine(s), the effective concentration of the amines in the final gel formulation is usually no more than about 30 wt. %, generally no more than about 10 wt. % and more commonly about 0.5 to 5 wt. %. The basic agent may include an amine compound, such as a polyalkylenepolyamine, alkanolamine and/or polyetheramine. Where the basic agent includes alkali metal hydroxide and/or alkaline earth hydroxide, the final gel formulation usually includes no more than about 3 wt. % and typically, about 0.05-0.5 wt. % of such inorganic basic material. Quite commonly inorganic basic material includes sodium hydroxide and/or potassium hydroxide.

One embodiment provides a cleaning composition for treating a hard surface which includes an adhesion promoter, a basic agent and water. The adhesion promoter includes an organic compound with at least one hydrophilic group. The cleaning composition typically also includes at least one surfactant selected from the group consisting of anionic, nonionic, cationic, amphoteric, and zwitterionic surfactants, and combinations thereof, where one or more of the surfactants can serve all or in part as the adhesion promoter. Commonly, the composition is self-adhering upon application to a hard surface. The cleaning composition generally contains a sufficient amount of the basic agent, such that an equilibrated mixture of 10 wt. % of the composition with deionized water has a pH of at least about 10. Suitable examples of adhesion promoters include polysaccharides, hydrophilic synthetic polymers and/or organic compounds which includes one or more one hydrophilic polyalkoxy groups. The cleaning composition may also include one or more additional components, such as a polyol humectant (e.g., glycerin), a fragrance component; nonionic surfactant(s), which is different from the adhesion promoter, mineral oil and may also include one or more additional adjuvants. For example, the cleaning compositions may also include one or more adjuvants, such as a fragrance, a complexing agent, and/or a bleaching agent.

In some embodiments, the present compositions may provide consumers with the benefit of delivering an active ingredient to a relatively wide area of a toilet bowl or other hard surface. In some embodiments, improved stability of a self-adhering composition may be achieved through the inclusion in the composition of certain blends of ethoxylated alcohol(s) together with a polymeric alkyleneoxide block copolymer, e.g., a ethyleneoxide-propyleneoxide block copolymer, or other surfactant. In many embodiments, a dose of the composition on a hard surface (such as the inside surface of a toilet bowl) can partially dissolve during and after each of periodic flows of water (e.g., toilet flushes) thereby providing a wet film, which typically emanates in all directions from the composition over the hard surface. The wet film which emanates from the dose over said hard surface can provide a delivery vehicle for active ingredients in the composition (e.g., cleaning agents, such as detersive surfactants and/or scale dissolving agents) for immediate and residual treatment of the hard surface. The composition may be used to deliver via the wet film at least one active agent present in the composition to extended areas of the hard surface away from the predetermined position of the dose placement.

In one aspect, a method for treating a hard surface using the self-adhering cleaning compositions described herein is also provided. The method typically includes applying a dose of the self-adhering composition directly on the hard surface to be treated, e.g., being dispensing an aerosol form of the composition onto a pre-determined portion of the hard surface. When water is passed over the self-adhering composition and the hard surface, a portion of the self-adhering composition is released into the water that flows over the dose. The portion of the self-adhering composition that is released into the flowing water may provide a wet film on at least a portion of the hard surface. For example, the method may be used to treat the inside of a toilet bowl. A dose of the self-adhering composition may be applied directly on an inside surface of the toilet bowl. When the toilet is flushed, water passes over the self-adhering dose such that a portion of the self-adhering composition is released into the water that flows through the toilet bowl.

Further, one of skill in the art will appreciate that, when used in conjunction with a metered dispenser, the dispenser may provide doses of the composition in any volume and/or size that is suitable for the intended application. Similarly, the shape of the dispenser may be any shape that is desired. For example, in an exemplary embodiment, a dispenser used to dispense the present gel composition, desirably via an aerosol application. Such a dispenser may be capable of dispensing the composition in a variety of shapes that are desirable for the intended purpose. Non-limiting examples of cross-sectional shapes may be selected from: squares, circles, triangles, ovals, stars, ring-shaped, and the like.

DETAILED DESCRIPTION

Figure 1:
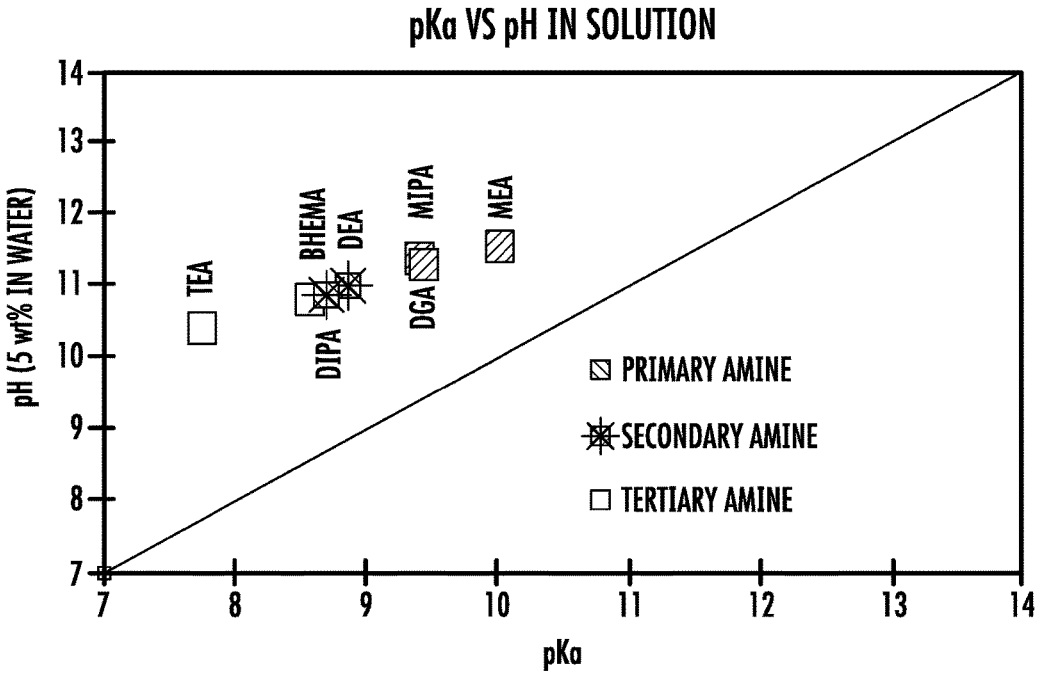
FIG. 1 is a graph of a plot of pH (for a 5 wt. % solution of the designated amine in deionized water) versus pKa for various primary, secondary and tertiary alkanolamines.

In use, the present composition may be applied directly on the hard surface to be treated, e.g. cleaned, such as a toilet bowl, shower or bath enclosure, drain, window, or the like, via an aerosol application and desirably self-adheres thereto, including through a plurality of flows of water passing over the self-adhering composition and surface, e.g. flushes, showers, rinses or the like. Each time water flows over the composition, a portion of the composition is released into the water that flows over the composition. The portion of the composition released onto the water covered surface provides a continuous wet film to the surface to in turn provide for immediate and long term cleaning and/or disinfecting and/or fragrancing or other surface treatment depending on the active agent(s) present in the composition. It is thought that the composition, and thus the active agents of the composition, may spread out from or are delivered from the initial composition placement in direct contact with the surface to coat continuously an extended area on the surface. The wet film may act as a coating and emanates from the self-adhering composition in all directions, i.e., 360 degrees, from the composition, which includes in a direction against the flow of the rinse water. Motions of the surface of a liquid are coupled with those of the subsurface fluid or fluids, so that movements of the liquid normally produce stresses in the surface and vice versa. The composition may be especially useful in treating the surface of a toilet bowl, since it can allow for delivery and retention of a desired active agent on a surface above the water line in the bowl as well as below the water line.

In one aspect, the cleaning composition may be capable of self-adhering to a hard surface and include a basic agent to reduce the corrosiveness of the material. The basic agent is desirably added in a sufficient amount such that an equilibrated mixture of 10 wt. % of the composition with deionized water has a pH of at least about 10 and more commonly at least about 10.5. When an amine(s) is included as the basic agent, the final gel formulation usually no more than about 10 wt. %, and more commonly about 0.5 to 5 wt % of the amine(s). In some instances, the final gel formulation includes an alkali metal hydroxide and/or alkaline earth hydroxide as the basic agent, usually no more than about 1 wt. % and typically, about 0.1-0.5 wt. % of such inorganic basic material (e.g., sodium hydroxide and/or potassium hydroxide).

In some embodiments the basic agent includes an alkanolamine. Examples of suitable alkanolamines for use as a basic agent include ethanolamines and/or propanolamines. The alkanolamine may be a monoalkanolamine, dialkanolamine, trialkanolamine and/or diglycolamine. For example, the basic agent may include monoethanolamine (MEA), diethanolamine (DEA) and/or triethanolamine (TEA). Other examples of suitable alkanolamines for use as a basic agent include N,N-dimethyl ethanolamine (DMEA), N-methyl diethanolamine (BHEMA), 2-amino-2-methyl-1-propanol and O-(2-hydroxyethyl)ethanolamine (DGA).

The alkanolamine may also include a compound having the formula:

$$R'—(O—CH_2—CHR)_Y—N—(CH_2—CH_2—O)_x—H—(CH_2—CH_2—O)_z—H$$

where x, z and y are integers from 1 to 5 and R' is a $C_{10}$-$C_{16}$ aliphatic group. One example of such an alkanol amine, where x and z are 2 or 3, y is 2 and R' is a $C_{14}$ aliphatic group, is sold under the trade name Surfonic PEA-25 by Huntsman Corporation.

In some embodiments the basic agent may include a polyalkylenepolyamine. Examples of suitable polyalkylenepolyamines include polyalkylenepolyamines having the formula:

$$H_2N—(CH_2—CHR—NH)_n—CH_2—CHR—NH_2 \text{ and/or}$$

$$H_2N—(CH_2—CH_2—CH_2—NH)_m—CH_2—CH_2—CH_2—NH_2$$

where R is H or Me; and n and m are 0 or an integer from 1 to 5. Typically, polyalkylenepolyamine has the formula: $H_2N—(CH_2—CH_2—NH)_1CH_2—CH_2—NH_2$. In some embodiments, the basic agent may desirably include triethylenetetraamine (TETA; n=2) and/or tetraethylenepentaamine (TEPA; n=3) as the polyalkylenepolyamine.

In some embodiments the basic agent may include a polyetheramine. Suitable examples include branched polyether amine containing at least 3 moles of ether subunits. Examples of suitable polyetheramines for use as a basic agent include compounds having the formula $$H_2N—CHMe\text{-}CH_2—(O—CH_2—CHMe)_x\text{-}NH_2$$

$$R''—(O—CH_2CH_2)_z—(O—CH_2—CHR)_x—NH_2$$

$$R''—(O—CH_2CH_2)_z—(O—CH_2—CHMe)_x\text{-}NH_2 \text{ and/or}$$

$$H_2N—CHMe\text{-}CH_2—(O—CH_2—CHMe)_y\text{-}(O—CH_2CH_2)_z—(O—CH_2—CHMe)_x\text{-}NH_2$$

wherein R is H or Me; R" is lower ($C_1$-$C_6$) alkyl, typically methyl and/or ethyl; x may be an integer from 1 to 50; z may be an integer from 1 to 20; and y may be an integer from 0 to 10.

Examples of suitable polyetheramines having the formula:

$$R''—(O—CH_2CH_2)_z—(O—CH_2—CHR)_x—NH_2$$

include compounds where z on average is about 3 to 10 (suitably 5-7) and x on average is about 20 to 50 (suitably 30-40). Typically such polyetheramines have an average molecular weight of about 1,000 to 3,000. One suitable example is JEFFAMINE® M-2070 polyetheramine sold by Huntsman Corporation. This polyetheramine is a monoamine based on a copolymer backbone, as shown by the representative structure where z=6 and x≈35, and is a monofunctional, primary amine with an average molecular weight of about 2,000. The propylene oxide/ethylene oxide (PO/EO) mole ratio is commonly about ⅓, where R═H for (EO), or $CH_3$ for (PO).

Examples of suitable polyetheramines having the formula:

$$H_2N—CHMe\text{-}CH_2—(O—CH_2—CHMe)_y\text{-}(O—CH_2CH_2)_z—(O—CH_2—CHMe)_x\text{-}NH_2$$

include compounds where z on average is about 5 to 15 and x+y equals about 2 to 8. Typically such polyetheramines have an average molecular weight of about 400 to 1,500. Suitable examples include JEFFAMINE® ED-600 and JEFFAMINE® ED-900 polyetheramines sold by Huntsman Corporation. JEFFAMINE® ED-600 polyetheramine, is water soluble liquid, is an aliphatic polyether diamine derived from a propylene oxide capped polyethylene glycol and has an approximate molecular weight of 600. In the structure shown, z 9 and (x+y) 3.6 for JEFFAMINE® ED-600. JEFFAMINE® ED-900 polyetheramine has a similar structure and is water soluble, with an approximate molecular weight of 900 and a melting point around room temperature. In the structure shown, z 12.5 and (x+y) 6 for JEFFAMINE® ED-900.

Examples of suitable polyetheramines having the formula:

$$H_2N—CHMe\text{-}CH_2—(O—CH_2—CHMe)_x\text{-}NH_2$$

include compounds where x on average is about 2 to 5. Typically such polyetheramines have an average molecular weight of about 200 to 300. One suitable example is JEFFAMINE® D-230 polyetheramine sold by Huntsman Corporation. This polyetheramine is characterized by repeating oxypropylene units in the backbone and is a difunctional, primary amine with an average molecular weight of about 230 (average of x≈2.5).

In certain aspects, the present cleaning compositions may include adhesion promoter, such as an alkoxylated alcohol, a basic agent, polyol humectant, mineral oil, polyethyleneglycol and water. The composition may also include an anionic surfactant (such as a ethoxylated fatty alcohol sulfate and/or sulfonate ester), fragrance and/or a $C_{10}$-$C_{15}$ fatty alcohol. For example, cleaning composition may include ethoxylated alcohol, basic agent, anionic sulfate ester (such as sodium laureth sulfate), glycerin, mineral oil, polyethyleneglycol and water. In an exemplary embodiment, the composition is an aqueous-based gel, which includes about 20-35 wt. % of an ethoxylated $C_{14}$-$C_{22}$ fatty alcohol having an average of 15 to 40 ethylene oxide units; about 10-25 wt.

% sodium laureth sulfate; about 2-10 wt. % glycerin; about 0.5-5 wt. % polyethyleneglycol; about 0.5-3 wt. % mineral oil; and at least about 40 wt. % water. Such aqueous-based compositions may also include about 1-10 wt. % of a fragrance component. These compositions typically include about 0.5 to 5 wt. % of an amine compound as the basic agent. In some embodiments, the compositions may include about 0.05-0.5 wt. % of an inorganic basic material, such as sodium hydroxide, as the basic agent.

In certain aspects, the present cleaning compositions may include adhesion promoter, such as an alkoxylated fatty alcohol, basic agent, polyol humectant, hydrophilic polyacrylate copolymer, ethoxylated $C_{10}$-$C_{15}$ alcohol nonionic surfactant, and water. The aqueous-based composition may also include fragrance, polyethyleneglycol and/or mineral oil. For example, cleaning composition may include ethoxylated alcohol (e.g., an ethoxylated $C_{14}$-$C_{22}$ fatty alcohol having an average of 15 to 40 ethylene oxide units), basic agent, glycerin, an ethoxylated $C_{10}$-$C_{15}$ alcohol having an average of 2 to 5 ethylene oxide units, an amphoteric polyacrylate copolymer containing pendent quaternary ammonium groups (e.g., MIRAPOL SURF S available from Rhodia), and water. In an exemplary embodiment, the aqueous-based composition is a gel, which includes about 20-35 wt. % of an ethoxylated $C_{14}$-$C_{22}$ fatty alcohol having an average of 15 to 40 ethylene oxide units; about 1-5 wt. % of the ethoxylated $C_{10}$-$C_{15}$ alcohol; about 2-10 wt. % glycerin; about 0.5-2 wt. % of the amphoteric polyacrylate copolymer and at least about 40 wt. % water. Such aqueous-based compositions may also include about 1-10 wt. % of a fragrance component, about 0.5-5 wt. % polyethyleneglycol and/or about 0.5-3 wt. % mineral oil. These compositions typically include about 0.5 to 5 wt. % of an amine compound as the basic agent. In some embodiments, the compositions may include about 0.05-0.5 wt. % of an inorganic basic material, such as sodium hydroxide, as the basic agent.

In certain aspects, the present cleaning compositions may include adhesion promoter, such as an alkoxylated fatty alcohol, basic agent, polyol humectant, mineral oil, cationic surfactant, and water. Such aqueous-based compositions may also include a fragrance component and/or other additives. For example, cleaning composition may include ethoxylated alcohol (e.g., an ethoxylated $C_{14}$-$C_{22}$ fatty alcohol having an average of 15 to 40 ethylene oxide units), basic agent, glycerin, mineral oil, a cationic surfactant such as an alkylpolyglucoside derivative having pendent quaternary ammonium groups, and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 0.5-3 wt. % mineral oil; about 2-10 wt. % glycerin; about 1-5 wt. % of the alkylpolyglucoside derivative; and at least about 40 wt. % water. Such aqueous-based compositions may also include about 1-10 wt. % of a fragrance component. These compositions typically include about 0.5 to 5 wt. % of an amine compound as the basic agent. In some embodiments, the compositions may include about 0.05-0.5 wt. % of an inorganic basic material, such as sodium hydroxide, as the basic agent.

In certain aspects, the present cleaning compositions may include adhesion promoter, such as an alkoxylated fatty alcohol, basic agent, an anionic surfactant (such as a ethoxylated fatty alcohol sulfate and/or sulfonate ester), polyol humectant, mineral oil, hydrophilic polyacrylate copolymer, and water. The aqueous-based composition may also include a fragrance component. For example, cleaning composition may include an ethoxylated alcohol (e.g., an ethoxylated $C_{14}$-$C_{22}$ fatty alcohol having an average of 15 to 40 ethylene oxide units), anionic sulfate ester (such as sodium laureth sulfate), glycerin, mineral oil, an amphoteric polyacrylate copolymer containing pendent quaternary ammonium groups (e.g., MIRAPOL SURF S available from Rhodia), and water. In an exemplary embodiment, the aqueous-based composition is a gel (in the absence of the propellant) which includes about 20-35 wt. % of an ethoxylated $C_{14}$-$C_{22}$ fatty alcohol having an average of 15 to 40 ethylene oxide units; about 10-25 wt. % sodium laureth sulfate; about 0.1-3 wt. % of the amphoteric polyacrylate copolymer; about 2-10 wt. % glycerin; about 1-3 wt. % mineral oil; and at least about 40 wt. % water. Such aqueous-based compositions may also include about 1-10 wt. % of a fragrance component. These compositions typically include about 0.5 to 5 wt. % of an amine compound as the basic agent. In some embodiments, the compositions may include about 0.05-0.5 wt. % of an inorganic basic material, such as sodium hydroxide, as the basic agent.

In certain aspects, the cleaning compositions include an alkoxylated alcohol (e.g., ethoxylated alcohol), polymeric alkyleneoxide block copolymer (e.g., a ethyleneoxide-propyleneoxide block copolymer), basic agent, mineral oil, and water. In some embodiments, the cleaning compositions may include one or more additional components, such as a natural or synthetic polymer resin, a polyol humectant (such as glycerin, sorbitol, and/or other sugar alcohol), and/or an anionic and/or amphoteric surfactant and/or nonionic surfactant which is not an alkoxylated alcohol. Optionally, the cleaning compositions may also include one or more adjuvants, such as a fragrance, a complexing agent, and/or a bleaching agent. The alkoxylated alcohol component may include a mixture of ethoxylated alcohols having varying degrees of ethoxylation. For example, the ethoxylated alcohol component may include an ethoxylated $C_{14}$-$C_{30}$ alcohol having an average of about 20 to 50 ethylene oxide units and an ethoxylated $C_8$-$C_{15}$ alcohol having an average of about 5 to 15 ethylene oxide units. In some embodiments, such compositions may be a gel having a gel yield point of at least about 2,500 Pa and/or a gel melt temperature of about 50-80° C.

In another aspect, the cleaning composition may be an adhesive cleaning composition in which the adhesion promoter includes a ethoxylated alcohol, e.g., an ethoxylated $C_{12}$-$C_{30}$ alcohol having an average of 15 to 50 ethylene oxide units, ethyleneoxide-propyleneoxide block copolymer, basic agent, mineral oil, and water. In some embodiments, the cleaning composition may include about 15-40 wt. % of a first ethoxylated alcohol, which is an ethoxylated $C_{14}$-$C_{30}$ alcohol having an average of 20 to 50 ethylene oxide units; about 1-15 wt. % ethyleneoxide-propyleneoxide block copolymer; about 0.5-10 wt. % mineral oil; basic agent and water. These compositions typically include about 0.5 to 5 wt. % of an amine compound as the basic agent. In some embodiments, the compositions may include about 0.05-0.5 wt. % of an inorganic basic material, such as sodium hydroxide, as the basic agent. The cleaning composition may often also include an ethoxylated $C_8$-$C_{15}$ alcohol having an average of about 5 to 15 ethylene oxide units.

The present composition may include a surfactant selected from nonionic, anionic, cationic, zwitterionic and/or amphoteric surfactants and mixtures thereof; wherein the surfactant is different from the adhesion promoter. In some embodiments, the composition may include up to about 20 wt. %, about 0.1 wt. % to 15 wt. %, about 0.5 to 10 wt. %, about 1 to about 5 wt. %, or about 10 to 20 wt. % of the surfactant. The surfactants may include one or more alkoxylated alcohols that are different from the adhesion promoter. The alkoxylated alcohol may include one or more ethoxylated alcohols. The ethoxylated alcohol may be linear or branched. In some embodiments, the ethoxylated alcohol may include a $C_8$-$C_{16}$ alcohol having an average of 5 to 15 ethylene oxide units, more commonly 5 to 12 ethylene oxide units. Typically, when present, the ethoxylated alcohol includes a $C_9$-$C_{15}$ linear and/or branched alcohol having an average of 5 to 12 ethylene oxide units. A non-limiting example is Genapol® X-100 (available from CLAMANT), which is a branched iso-$C_{13}$ alcohol ethoxylate having an average of 10 ethylene oxide units.

Other ethoxylated alcohols that may be present in the present cleaning compositions as a nonionic surfactant include linear or branched ethoxyated alcohols including a $C_5$-$C_{15}$ alcohol having an average of 4 to 12 ethylene oxide units. Nonlimiting examples include Tomadol® 91-6—a $C_9$-$C_{11}$ ethoxylated alcohol having an average of 6 ethylene oxide units (available from Air Products and Chemicals, Inc.), LUTENSOL® AO-8—a synthetic $C_{13}$-$C_{15}$ ethoxylated oxo alcohol having an average of 8 ethylene oxide units (available from BASF), Genapol® LA 070S—an ethoxylated lauryl alcohol having an average of 7 ethylene oxide units (available from CLAMANT), and TERGITOL™ 15-S-7, a branched secondary ethoxylated alcohol with 7 ethylene oxide units (available from DOW Chemical). Other examples of suitable ethoxylated linear alcohols include ethoxylated linear alcohols having a $C_{10}$-$C_{15}$ n-alkyl group, e.g., having an average of 5 to 12 ethylene oxide units. Nonlimiting examples include LUTENSOL® TDA 10 (available from BASF)—an ethoxylated tridecyl alcohol having an average of 10 EO groups.

Other nonionic surfactants which may be present include, but are not limited to, secondary ethoxylated alcohols, such as $C_{11}$-$C_{15}$ secondary ethoxylated alcohols. Secondary ethoxylated alcohols suitable for use are sold under the tradename TERGITOL® (available from Dow Chemical). For example TERGITOL® 15-S, more particularly TERGITOL® 15-S-12 is a $C_{11}$-$C_{15}$ secondary ethoxylate alcohol having an average of about 12 ethylene oxide groups.

Other exemplary useful nonionic surfactants include a variety of known nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic surfactant compound with varying degrees of water solubility—depending on the relative length of the hydrophobic and hydrophilic polyethylenoxy elements. Exemplary nonionic compounds include the polyoxyethylene ethers of alkyl aromatic hydroxy compounds, e.g., alkylated polyoxyethylene phenols, polyoxyethylene ethers of long chain aliphatic alcohols (e.g., ethoxylated alcohols), the polyoxyethylene ethers of hydrophobic propylene oxide polymers, and the higher alkyl amine oxides.

Further nonionic surfactants which may be optionally present in the compositions are alkyl polyglycosides (e.g. Glucopon® 425N). Suitable alkyl polyglycosides include known nonionic surfactants which are alkaline and electrolyte stable. Alkyl mono and polyglycosides are generally prepared by reacting a monosaccharide, or a compound hydrolyzable to a monosaccharide with an alcohol such as a fatty alcohol in an acid medium. The fatty alcohol may have from about 8 to 30 and typically 8 to 18 carbon atoms. Examples of such alkylglycosides include, APG 325 CS GLYCOSIDE which is reported to be a 50% $C_9$-$C_{11}$ alkyl polyglycoside (commercially available from Henkel Corp, Ambler Pa.) and GLUCOPON® 625 CS which is reported to be a 50% $C_{10}$-$C_{16}$ alkyl polyglycoside. In some embodiments, the nonionic surfactant may include an alkylpolyglycoside and/or an ethoxylated $C_8$-$C_{15}$ alcohol having an average of 5 to 12 ethylene oxide units.

Alkylpolyglycosides suitable for use in the present compositions may have the formula:

$$RO—(R'O)_x—Z_n$$

where R is a monovalent aliphatic radical containing 8 to 20 carbon atoms (the aliphatic group may be straight or branched, saturated or unsaturated), R' is a divalent alkyl radical containing 2 to 4 carbon atoms, preferably ethylene or propylene, x is a number having an average value of 0 to about 12, Z is a reducing saccharide moiety containing 5 or 6 carbon atoms, such as a glucose, galactose, glucosyl, or galactosyl residue, and n is a number having an average value of about 1 to 10. Some exemplary alkyl polyglycosides are sold under the name GLUCOPON® (where Z is a glucose moiety and x=0).

Additional suitable nonionic surfactants include linear alkyl amine oxides. Typical linear alkyl amine oxides include water-soluble amine oxides of the formula $R^1$—N($R^2$)($R^3$)O where $R^1$ is typically a $C_8$-$C_{18}$ alkyl moiety and the $R^2$ and $R^3$ moieties are typically selected from the group consisting of hydrogen, $C_1$-$C_3$ alkyl groups, and $C_1$-$C_3$ hydroxyalkyl groups. Quite often, $R^1$ is a $C_8$-$C_{18}$ n-alkyl and $R^2$ and $R^3$ are methyl, ethyl, propyl, isopropyl, 2-hydroxyethyl, 2-hydroxypropyl, and/or 3-hydroxypropyl. The linear amine oxide surfactants in particular may include linear $C_{10}$-$C_{18}$ alkyl dimethyl amine oxides and linear $C_8$-$C_{12}$ alkoxy ethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide).

Additional suitable nonionic surfactants include polyethoxylated fatty esters. These include, for example, polyethoxylated sorbitan monooleate, sorbitan monolaurate, sorbitan monopalmitate and/or sorbitan monostearate, and polyethoxylated castor oil. Specific examples of such surfactants are the products of condensation of ethylene oxide (e.g., 10-25 moles) with sorbitan monooleate and condensation of ethylene oxide (e.g., 20-40 moles) with castor oil.

The composition may further include one or more of mineral oil, polyol humectant, and adjuvants. In some embodiments, the composition may further include one or more of mineral oil, polyol humectant, an antimicrobial agent, and a fragrance component. In some embodiments, the composition may include up to about 10 wt. %, about 0.1 to 5 wt. %, or about 0.2 to 3 wt. % mineral oil.

Examples of suitable polyol humectants include glycerin, glycols, such as ethylene glycol, propylene glycol, diethylene glycol, dipropylene glycol, butylene glycol and the like, sugar alcohols such as sorbitol, xylitol, and maltitol, sugars such as glucose, galactose, or compounds with glucosyl or galactosyl residues, and mixtures thereof. In some embodiments, the composition may include up to about 20 wt. % of a polyol humectant or more commonly about 1 wt. % to 10 wt. %. In some embodiments, the composition may include about 1 wt. % to 10 wt. % or about 1 wt. % to 5 wt. % glycerin.

As used herein, adjuvants include components or agents, such as additional functional materials. In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present compositions may optionally include other soil-digesting components, surfactants, disinfectants, detergent fillers, sanitizers, acidulants, complexing agents, biocides and/or antimicrobial agents, corrosion inhibitors, anti-redeposition agents, foam inhibitors, opacifying agents such as titanium dioxide, dyes, bleaching agents (hydrogen peroxide and other peroxides), enzymes, enzyme stabilizing systems, builders, thickening or gelling agents, wetting agents, dispersants, stabilizing agents, dispersant polymers, cleaning compounds, pH adjusting agents (acids and alkaline agents), stain preventers, and/or fragrances. In some embodiments, the composition may include up to about 10 wt. %, about 1 wt. % to 10 wt. %, or about 2 wt. % to 8 wt. % of a fragrance component.

In one embodiment, a composition according to the present technology may be provided in a dispenser wherein the dispenser provides unitized doses. In a particular embodiment, the unitized dose may be from about 4 g/dose to about 10 g/dose. In another embodiment, the unitized dose may be from about 5 g/dose to about 9 g/dose. In yet another embodiment, the dispenser may provide from about 6 to about 8 g/dose unitized doses. In some embodiments, the dispenser may provide from about 3 to about 12 unitized doses. In some embodiments, the dispenser may be refilled with additional composition.

As used herein, "composition" refers to any solid, gel and/or paste substance having more than one component.

As used herein, "self-adhering" or "self-adhesive" refers to the ability of a composition to stick onto a hard surface without the need for a separate adhesive or other support device. In some embodiments, the present self-adhering composition does not leave any residue or other substance (i.e., additional adhesive) once the composition is used up.

As used herein, "gel" refers to a disordered solid composed of a liquid with a network of interacting particles or polymers which has a non-zero yield stress.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. For the purposes of this application, a hard surface does not include silicon wafers and/or other semiconductor substrate materials. Nonlimiting examples of ceramic surfaces include: toilet bowl, sink, shower, tile, the like, and combinations thereof. A non-limiting example of a glass surfaces includes: window and the like. Nonlimiting examples of metal surfaces include: drain pipe, sink, the like. Nonlimiting examples of a polymeric surface includes: PVC piping, fiberglass, acrylic, Corian®, the like. A nonlimiting example of a stone hard surface includes: granite, marble, and the like.

A hard surface may be any shape, size, or have any orientation that is suitable for its desired purpose. In one non-limiting example, a hard surface may be oriented in a vertical configuration. In another non-limiting example, a hard surface may be the surface of a curved surface, such as a ceramic toilet bowl. In yet another non-limiting example, a hard surface may be the inside of a pipe, which has vertical and horizontal elements, and also may have curved elements. It is thought that the shape, size and/or orientation of the hard surface will not affect the present compositions, because of the unexpectedly strong transport properties of the compositions under the conditions described infra.

As used herein, "surfactant" refers to any agent that lowers the surface tension of a liquid, for example water. Exemplary surfactants which may be suitable for use with the present compositions are described infra. In one embodiment, surfactants may be selected from the group consisting of anionic, non-ionic, cationic, amphoteric, zwitterionic, and combinations thereof. In one embodiment, the cleaning composition may be substantially free of a cationic surfactant. In some embodiments, the cleaning composition may be substantially free of an anionic surfactant.

As used herein, "substantially free" refers to a composition that includes less than about 0.1 wt %, or is absent of any detectable amount of the referenced component.

As used herein, "gel melt temperature" refers to the temperature at which a gel composition transitions to a viscosity of less than about 100 cps as the temperature of the gel is raised. Measurements are taken using a TA Instruments AR 2000 Advanced Series Rheometer using a 4 cm stainless steel parallel plate geometry with a gap of 750 microns, a temperature ramp of 5° C./min, temperature range from 30° C. to 80° C., and a shear rate of 5 s^-1. In one embodiment, the gel melt temperature may be at least about 50° C., at least about 55° C., or at least about 60° C. In another embodiment, the gel melt temperature may be no more than about 80° C., no more than about 75° C., or no more than about 70° C. The gel melt temperature may range from about 50° C. to 80° C. In some embodiments, the gel melt temperature may range from about 55° C. to 75° C. or more desirably from about 60° C. to 70° C.

As used herein, "gel yield point" refers to the minimum stress required for the composition to transition from a solid, elastic state to a viscous, fluidic state. As referred to herein the gel yield point is determined using a TA Instruments AR 2000 Advanced Series Rheometer using a 4 cm stainless steel parallel plate geometry with a gap of 750 microns, a temperature ramp of 5 C/min, temperature range from 30 C to 80° C., and a shear rate of 5 s^-1. In some embodiments, the present gel compositions may have yield points of about 2,500 to 4,500 Pa, but more desirably about 3,000 to 4,000 Pa.

Examples

The following examples are intended to more specifically illustrate the present cleaning compositions according to various embodiments described above. These examples should in no way be construed as limiting the scope of the present technology.

Table 1 below shows the composition of a number of exemplary formulations of non-corrosive gels according to the present application. The formulations (A, B or C) can be prepared with either about 1-4 wt. % amine or 0.1-0.3 wt. % NaOH added as a basic agent. The gel points and viscosities (in kcP at 30° C.) for the corresponding formulation without any added basic agent are listed in the Table for comparison purposes.

Figure 2:
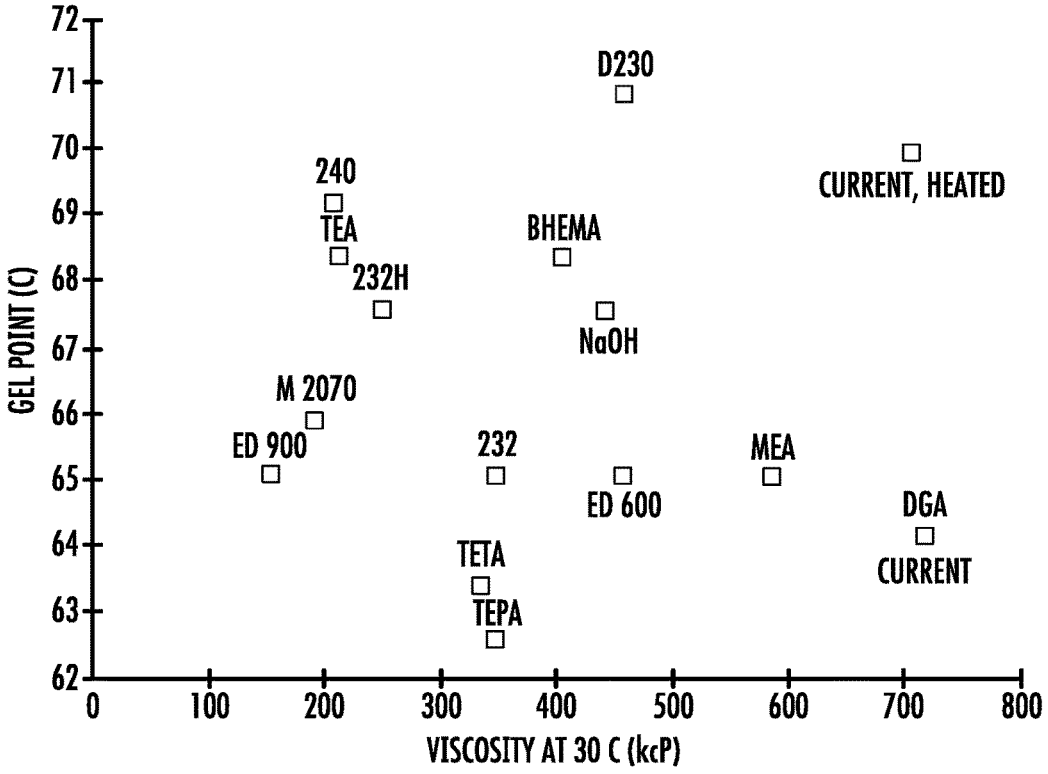
FIG. 2 is a graph of a plot of gel point (in ° C.) versus viscosity at 30° C. (in kcP) for gels based on Formulation B containing either 3 wt. % of the indicated amine or 0.15 wt. % sodium hydroxide (NaOH).

Examples of formulations patterned after Formulation (B) containing 3 wt. % of a variety of amines or 0.15 wt. % NaOH were prepared and the gel points and viscosities of the resulting gels were determined. The exemplary gels were prepared using a variety of alkanolamines (MEA, TEA, DGA and BHEMA), polyetheramines (JEFFAMINE® D-230, ED 600, ED 900 and M-2070) and polyalkylenepolyamines (TETA and TEPA). FIG. 2 illustrates the relative effect of including these basic agents on the gel points and ambient temperature viscosities. The addition of the alkanolamines MEA and DGA, polyetheramines D-230, ED 600, ED 900 and M-2070 and polyalkylenepolyamines TETA and TEPA produced gels with gel points very similar to the corresponding formulation without added basic agent (e.g., gel points of about 62-66° C.). The addition of the alkanolamines MEA, BHEMA and DGA, polyetheramine D-230 and polyalkylenepolyamines TETA and TEPA resulted in gels having a viscosity at 30° C. in the range from 300 to 700 kcP.

Figure 3:
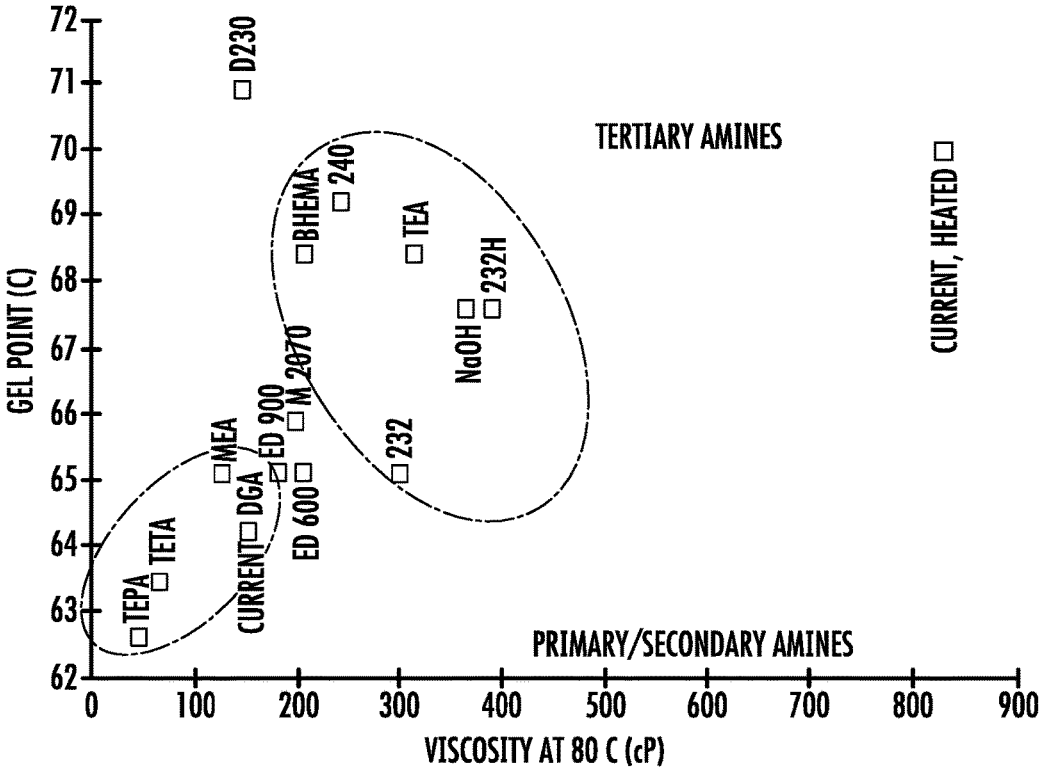
FIG. 3 is a graph of a plot of gel point (in ° C.) versus viscosity at 80° C. (in cP) for gels based on Formulation B containing either 3 wt. % of the indicated amine or 0.15 wt. % NaOH.

FIG. 3 illustrates the relative effect of including various basic agents in Formulation (B) on the on the high temperature viscosity (at 80° C.) of the gels. Gels having a lower viscosity at such a temperature can facilitate manufacturing processes for products formed from such gels. FIG. 3 is a graph of a plot of gel point (in ° C.) versus viscosity at 80° C. (in cP) for various gels based on Formulation (B). the large majority of the gels tested exhibit viscosities of no more than about 250 cP at this elevated temperature. Particularly notable are the gels which include addition of the alkanolamines MEA, BHEMA and DGA, polyetheramines D-230, ED 600, ED 900 and M-2070, and polyalkylenepolyamines TETA and TEPA.

TABLE 1

| Gel Formulations | | | | | | |
|---|---|---|---|---|---|---|
| Ingredient | (A) w/ Amine | (A) w/ NaOH | (B) w/ Amine | (B) w/ NaOH | (C) w/ Amine | (C) w/ NaOH |
| $C_{16}$-$C_{22}$ ROH-30 EO | 25-30 | 25-30 | | | | |
| $C_{16}$-$C_{18}$ ROH-25 EO | | | 25-35 | 25-35 | 25-35 | 25-35 |
| SLES-2 EO | 10-20 | 10-20 | | | | |
| n-$C_{12/13}$ ROH | 0.1-2 | 0.1-2 | | | | |
| i-$C_{13}$ ROH-nEO | | | 2-5 | 2-5 | 2-5 | 2-5 |
| Glycerin | 3-8 | 3-8 | 3-8 | 3-8 | 3-8 | 3-8 |
| Mirapol Surf S500 | | | 0.5-2 | 0.5-2 | 0.5-2 | 0.5-2 |
| Mineral Oil | 0.5-2 | 0.5-2 | 0.5-2 | 0.5-2 | | |
| Fragrance | 3-10 | 3-10 | 3-10 | 3-10 | 3-10 | 3-10 |
| PEG 6000 | 0.5-3 | 0.5-3 | | | | |
| Amine | 1-4 | | 1-4 | | 1-4 | |
| NaOH | | 0.1-0.3 | | 0.1-0.3 | | 0.1-0.3 |
| Gel Point (° C.)* | 60-70 | 60-70 | 60-70 | 60-70 | 65-75 | 65-75 |
| Viscosity (kcP) at 30° C.* | 500-700 | 500-700 | 600-800 | 600-800 | 550-750 | 550-750 |

*in absence of added basic agent

Figure 4:
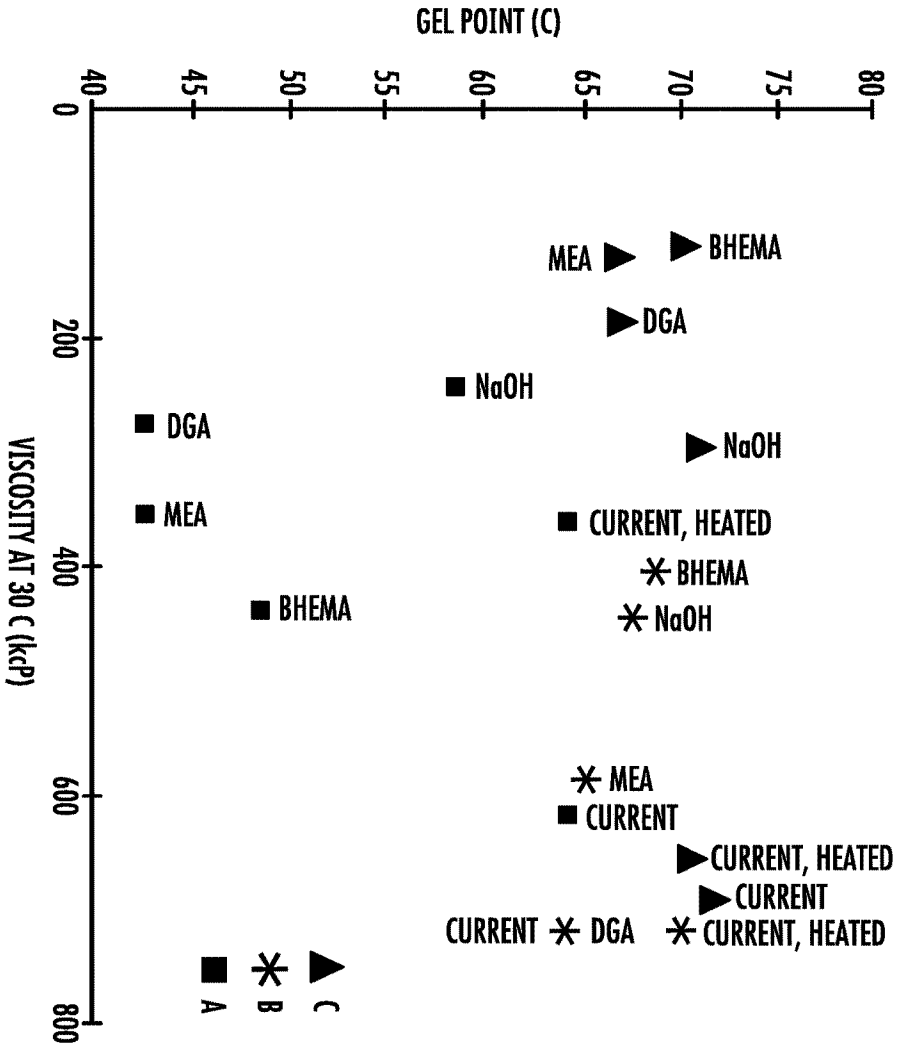
FIG. 4 is a graph of a plot of gel point (in ° C.) versus viscosity at 30° C. (in kcP) for gels based on either Formulation A, B or C containing either 3 wt. % of the indicated amine or 0.15 wt. % NaOH.

FIG. 4 illustrates the relative effect of including various basic agents in Formulation (A), (B) or (C) on the gel points and ambient temperature viscosities of the gels. The "ideal region" targeted for these properties is a gel point of about 55-70° C. and a viscosity (at 30° C.) of about 300,000-700,000 cP. A number of the examples meet these criteria, including gels based on Formulation (B) including the alkanolamine MEA, BHEMA or DGA, or with added NaOH. Gels based on Formulation (A) including added NaOH and Formulation (C) including the alkanolamine MEA, BHEMA or DGA, or with added NaOH exhibited gel points within the target range with acceptable viscosities (>150.00 cP at 30° C.).

Illustrative Embodiments

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

One embodiment provides a cleaning composition for treating a hard surface which includes an adhesion promoter, which comprises an organic compound with at least one hydrophilic group, a basic agent and water. The cleaning composition typically also includes at least one surfactant selected from the group consisting of anionic, nonionic, cationic, amphoteric, and zwitterionic surfactants, and combinations thereof, where one or more of the surfactants can serve all or in part as the adhesion promoter. Commonly, the composition is self-adhering upon application to a hard surface. The cleaning composition generally contains a sufficient amount of the basic agent, such that an equilibrated mixture of 10 wt. % of the composition with deionized water has a pH of at least about 10. Suitable examples of adhesion promoters include polysaccharides, hydrophilic synthetic polymers and/or organic compounds which includes one or more one hydrophilic polyalkoxy groups. For example, the adhesion promoter may include a hydrophilic synthetic polymer, such as a polyacrylate(s), a polyvinyl alcohol(s) and/or a polyvinyl pyrrolidone(s). In some instances, the adhesion promoter may suitably include polysaccharide, such as sodium carboxymethyl cellulose, hydroxyethyl cellulose, hydroxypropyl cellulose, xanthan gum, agar, gelatin gum, acacia gum, carob bean flour, and/or guar gum. Commonly, the adhesion promoter includes an organic compound, which includes at least one hydrophilic polyalkoxy group. Suitable examples of such organic compounds include polyethylene glycol, alkoxylated alcohols, alkoxylated polyol partial esters and/or polymeric alkylene oxide block copolymers. In many embodiments, the cleaning composition is a gel which has a viscosity of at least about 150,000 mPs at 25° C., more commonly about 250,000 to 600,000 mPs at 25° C.

In some embodiments, the basic agent includes an amine compound which comprises polyalkylenepolyamine, alkanolamine and/or polyetheramine. The cleaning composition may include up to about 10 wt. % of the amine compound. Suitably the cleaning composition includes about 0.5-10 wt. %, commonly about 1-5 wt. % of the amine compound.

In some embodiments, the basic agent includes an alkali metal hydroxide and/or alkaline earth hydroxide. The cleaning composition may include up to about 3 wt. % of the alkali metal hydroxide and/or alkaline earth hydroxide. When the basic agent includes alkali metal hydroxide and/or alkaline earth hydroxide, final gel formulation usually includes no more than about 1 wt. % and typically, about 0.05-0.5 wt. % of such inorganic basic material. Often the final gel formulation includes about 0.1-0.3 wt. % sodium hydroxide and/or potassium hydroxide.

In some embodiments, the basic agent includes alkanolamine, such as a monoalkanolamine, dialkanolamine, trialkanolamine and/or diglycolamine. Examples of suitable alkanolamines include ethanolamines and/or propanolamines. Other examples of suitable alkanolamines include monoethanolamine (MEA), diethanolamine, triethanolamine, N,N-dimethyl ethanolamine (DMEA), N-methyl diethanolamine (BHEMA), 2-amino-2-methyl-1-propanol and/or O-(2-hydroxyethyl)ethanolamine (DGA).

In some embodiments, the basic agent may include a polyalkylenepolyamine, such as polyalkylenepolyamines having the formula:

$$H_2N—(CH_2—CHR—NH)_n—CH_2—CHR—NH_2 \text{ and/or}$$

$$H_2N—(CH_2—CH_2—CH_2—NH)_m—CH_2—CH_2—CH_2—NH_2$$

where R is H or Me; and n and m are 0, 1, 2, 3 or 4. Typically, the polyalkylenepolyamine has the formula: $H_2N—(CH_2—CH_2—NH)_n—CH_2—CH_2—NH_2$ where n is 1, 2 and/or 3.

In some embodiments the basic agent may include a polyetheramine having the formula $$H_2N—CHMe\text{-}CH_2—(O—CH_2—CHMe)_x\text{-}NH_2$$

where z on average is about 3 to 10 (suitably 5-7) and x on average is about 20 to 50 (suitably 30-40). Such polyetheramines may have an average molecular weight of about 1,000 to 3,000.

In some embodiments, the basic agent may include a polyetheramine having the formula:

$$H_2N—CHMe\text{-}CH_2—(O—CH_2—CHMe)_y\text{-}(O—CH_2CH_2)_z—(O—CH_2—CHMe)_x\text{-}NH_2$$

where z on average is about 5 to 15 and x+y equals about 2 to 8. Such polyetheramines may have an average molecular weight of about 400 to 1,500.

In some embodiments, the basic agent may include a polyetheramine having the formula:

$$H_2N—CHMe\text{-}CH_2—(O—CH_2—CHMe)_x\text{-}NH_2$$

where x on average is about 2 to 5 and the polyetheramines typically has an average molecular weight of about 200 to 300.

In many embodiments, the cleaning composition includes an adhesion promoter which includes ethoxylated alcohol, ethyleneoxide-propyleneoxide block copolymer and/or polyethylene glycol. For example, the adhesion promoter may include ethoxylated $C_{14}$-$C_{22}$ alcohol having an average of 15 to 50 ethylene oxide units and an ethyleneoxide-propyleneoxide block copolymer. Such gels commonly also include mineral oil; polyol humectant; and optionally, a fragrance component.

In one embodiment, the cleaning composition is a gel which includes ethoxylated $C_{14}$-$C_{22}$ alcohol having an average of 15 to 50 ethylene oxide units as an adhesion promoter. The composition also includes polyol humectant; hydrophilic polyacrylate; one or more ethoxylated linear primary alcohols having an average of 2 to 10 ethylene oxide units, wherein each alcohol includes a carbon chain containing 8 to 15 carbons; and optionally, a fragrance component. Such gels may desirably include DGA, MEA, BHEMA, TETA, TEPA and/or ED 600 as a basic agent.

In one embodiment, the cleaning composition is a gel which includes polyethylene glycol and ethoxylated $C_{14}$-$C_{22}$ alcohol having an average of 15 to 50 ethylene oxide units; and also includes polyol humectant; hydrophilic polyacrylate; one or more linear primary alcohols, wherein each alcohol includes a carbon chain containing 8 to 15 carbons; anionic surfactant; and optionally, a fragrance component. Such gels may desirably include an alkanolamine, such as DGA, MEA, and/or BHEMA, as a basic agent. In other embodiments, such gels may include a polyalkylenepolyamine, e.g., triethylenetetraamine (TETA) and/or tetraethylenepentaamine (TEPA) as a basic agent.

In some embodiments, the cleaning composition is a gel, which includes an adhesion promoter and has a viscosity 25° C. of at least about 150,000 cP and, commonly, about 300,000 to 800,000 centipoise (cP). The gel may suitably include an adhesion promoter, which includes an ethoxylated linear $C_{14}$-$C_{22}$ primary aliphatic alcohol having an average of 20-35 ethylene oxide units. The gel typically has a gel melt temperature of about 50-80° C., more desirably about 55-70° C. In some instances the gel may have a gel yield point of at least about 2,500 Pa. The composition may also include one or more of polyol humectant, a fragrance component, a nonionic surfactant, which is different from the adhesion promoter, mineral oil, and/or one or more adjuvants. In a many instances, the gel may desirably include an amine such as DGA, MEA, DEA, TEA, BHEMA, TETA, TEPA, ED 600, ED 900, D 230 and/or M 2070 as the basic agent. It may be particular advantageous to form such a gel which includes DGA, MEA, DEA, TEA, BHEMA, TETA and/or TEPA as the basic agent.

In some embodiments, the cleaning composition is a gel, which includes about 20 to 35 wt. % of an ethoxylated $C_{16}$-$C_{18}$ alcohol having an average of 15 to 35 ethylene oxide units; about 1 to 5 wt. % of an ethoxylated $C_{10}$-$C_{15}$ alcohol having an average of 2 to 15 ethylene oxide units; about 0.5 to 5 wt. % of an amine compound which includes a polyalkylenepolyamine, alkanolamine and/or polyetheramine; zero to about 5 wt. % polyethylene glycol; about 0.1 to 2 wt. % mineral oil; about 2 to 10 wt. % glycerin; about 0.1 to 2 wt. % hydrophilic polyacrylate; about 2 to 10 wt. % of a fragrance component; and at least about 40 wt. % water.

In some embodiments, the cleaning composition is a gel, which includes about 20 to 35 wt. % of an ethoxylated $C_{16}$-$C_{18}$ alcohol having an average of 15 to 35 ethylene oxide units; about 1 to 5 wt. % of an ethoxylated $C_{10}$-$C_{15}$ alcohol having an average of 2 to 15 ethylene oxide units; about 0.05-0.5 wt. % sodium hydroxide; zero to about 5 wt. % polyethylene glycol; about 0.1 to 2 wt. % mineral oil; about 2 to 10 wt. % glycerin; about 0.1 to 2 wt. % hydrophilic polyacrylate; about 2 to 10 wt. % of a fragrance component; and at least about 40 wt. % water.

Scheme A (attached) shows the structure of a number of illustrative amine compounds which are suitable for use in the present cleaning gels.

In will be readily apparent to one skilled in the art that varying substitutions and modifications may be made to the methods and compositions disclosed herein without departing from the scope and spirit of the invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values are provided for embodiments, additional embodiments are described by taking any two different values as the endpoints of a range. Such ranges are also within the scope of the described invention.

What is claimed is:

1. A composition for treating a hard surface comprising (a) adhesion promoter, which comprises an organic compound with at least one hydrophilic group;

(b) at least one nonionic surfactant, which can serve all or in part as the adhesion promoter; wherein the nonionic surfactant comprises an ethoxylated $C_{12}$-$C_{30}$ fatty alcohol having an average of 15 to 50 ethylene oxide units;

(c) polyetheramine; and (d) water;

wherein the composition is a gel having a gel melt temperature of about 50-80° C. and a viscosity at 25° C. of at least 300,000 centipoise (cP) and is self-adhering upon application to a hard surface; and an equilibrated mixture of 10 wt. % of the composition with deionized water has a pH of at least about 10; and the composition comprises about 15 to 40 wt. % of the ethoxylated $C_{12}$-$C_{30}$ fatty alcohol.

2. The composition of claim 1, wherein the organic compound comprises one or more one hydrophilic polyalkoxy groups.

3. The composition of claim 1 wherein the gel has a viscosity of 300,000 to 800,000 cP at 25° C.

4. The composition of claim 1, wherein the composition further comprises an amine compound comprising a polyalkylenepolyamine and/or alkanolamine.

5. The composition of claim 1, wherein the polyetheramine has the formula $$H_2N—CHMe\text{-}CH_2—(O—CH_2—CHMe)_x\text{-}NH_2$$

wherein x is an integer from 1 to 10.

6. The composition of claim 1, wherein the aqueous-based composition further comprises one or more of:

(e) polyol humectant;

(f) a fragrance component;

(g) one or more linear primary alcohols, wherein each alcohol comprises a carbon chain containing 8 to 15 carbons; and (i) one or more adjuvants.

7. The composition of claim 2, wherein the organic compound is polyethylene glycol, an alkoxylated alcohol, an alkoxylated polyol partial ester and/or a polymeric alkylene oxide block copolymer.

8. The composition of claim 2, wherein the adhesion promoter comprises ethoxylated alcohol, ethyleneoxide-propyleneoxide block copolymer and/or polyethylene glycol.

9. The composition of claim 1, further comprising a fragrance component.

10. The composition of claim 1, wherein the adhesion promoter comprises ethoxylated $C_{14}$-$C_{22}$ alcohol having an average of 15 to 50 ethylene oxide units and an ethyleneoxide-propyleneoxide block copolymer;

and the composition further comprises mineral oil; polyol humectant; and optionally, a fragrance component.

11. The composition of claim 1, wherein the adhesion promoter comprises ethoxylated $C_{14}$-$C_{22}$ alcohol having an average of 15 to 50 ethylene oxide units; and the composition further comprises polyol humectant; hydrophilic polyacrylate; one or more ethoxylated linear primary alcohols having an average of 2 to 10 ethylene oxide units, wherein each alcohol comprises a carbon chain containing 8 to 15 carbons; and optionally, a fragrance component.

12. The composition of claim 1, wherein the adhesion promoter comprises polyethylene glycol and ethoxylated $C_{14}$-$C_{22}$ alcohol having an average of 15 to 50 ethylene oxide units; and the composition further comprises polyol humectant; hydrophilic polyacrylate; one or more linear primary alcohols, wherein each alcohol includes a carbon chain containing 8 to 15 carbons; anionic surfactant; and optionally, a fragrance component.

13. The composition of claim 1, wherein the polyetheramine has the formula:

$$H_2N—CHMe\text{-}CH_2—(O—CH_2—CHMe)_y\text{-}(O—CH_2CH_2)_z—(O—CH_2—CHMe)_x\text{-}NH_2$$

wherein z, x and y are integers, z on average is about 5 to 15 and x+y equals 2 to 8; and the polyetheramine has an average molecular weight of about 400 to 1,500.

14. The composition of claim 1, wherein the gel has a gel yield point hardness of at least about 2,500 Pa.

15. The composition of claim 1 wherein the composition comprises:

about 20 to 35 wt. % of an ethoxylated $C_{16}$-$C_{18}$ alcohol having an average of 15 to 35 ethylene oxide units;

about 1 to 5 wt. % of an ethoxylated $C_{10}$-$C_{15}$ alcohol having an average of 2 to 15 ethylene oxide units;

about 0.5 to 5 wt. % of the polyetheramine;

zero to about 5 wt. % polyethylene glycol;

about 0.1 to 2 wt. % mineral oil;

about 2 to 10 wt. % glycerin;

about 0.1 to 2 wt. % hydrophilic polyacrylate;

about 2 to 10 wt. % of a fragrance component; and at least about 40 wt. % water.

16. The composition of claim 15, wherein the composition has a viscosity at 25° C. of 300,000 to 800,000 centipoise (cP).

17. The composition of claim 1, wherein the polyetheramine has the formula $$R'—(O—CH_2CH_2)_z—(O—CH_2—CHMe)_x\text{-}NH_2$$

wherein R' is $C_1$-$C_6$ alkyl; x is an integer from 1 to 50; and z is an integer from 1 to 10.

18. The composition of claim 1, wherein the polyetheramine has the formula $$H_2N—CHMe\text{-}CH_2—(O—CH_2—CHMe)_y\text{-}(O—CH_2CH_2)_z—(O—CH_2—CHMe)_x\text{-}NH_2$$

wherein z is an integer from 1 to 20; and y is an integer from 0 to 10; and x is an integer from 1 to 50.

19. The composition of claim 18, wherein a sum of (y+z) is about 2 to 10.

20. The composition of claim 1, further comprising an amphoteric polyacrylate copolymer containing pendent quaternary ammonium groups.

21. The composition of claim 1, further comprising one or more of polyethylene glycol, mineral oil and polyol humectant.

22. The composition of claim 1, wherein the polyetheramine has the formula:

$$R''—(O—CH_2CH_2)_z—(O—CH_2—CHR)_x—NH_2$$

wherein R is H or Me; R" is $C_1$-$C_6$ alkyl; z on average is about 3 to 10 and x on average is about 20 to 50 and the polyetheramine has an average molecular weight of about 1,000 to 3,000.

23. The composition of claim 1, wherein the polyetheramine having the formula:

$$H_2N—CHMe\text{-}CH_2—(O—CH_2—CHMe)_x\text{-}NH_2$$

wherein is an integer and the polyetheramine has an average value for x of about 2 to 5; and the polyetheramine has an average molecular weight of about 200 to 300.

24. A composition for treating a hard surface comprising (a) adhesion promoter, which comprises alkoxylated alcohol, alkoxylated polyol partial ester, polyethylene glycol and/or polymeric alkylene oxide block copolymer;

(b) at least one surfactant selected from the group consisting of: nonionic, cationic, amphoteric, zwitterionic, and combinations thereof; wherein one or more of the at least one surfactant can serve all or in part as the adhesion promoter;

(c) polyetheramine; and (d) water;

wherein the composition is a gel having a gel yield point hardness of at least about 2,500 Pa and a viscosity at 25° C. of at least 300,000 cP and is self-adhering upon application to a hard surface; and an equilibrated mixture of 10 wt. % of the composition with deionized water has a pH of at least about 10; and the composition comprises about 15 to 40 wt. % ethoxylated $C_{12}$-$C_{30}$ fatty alcohol.

25. The composition of claim 24, wherein the polyetheramine formula (I), (II) and/or (III):

$$H_2N—CHMe\text{-}CH_2—(O—CH_2—CHMe)_x\text{-}NH_2 \quad (I)$$

$$R'—(O—CH_2CH_2)_z—(O—CH_2—CHMe)_y\text{-}NH_2 \quad (II)$$

$$H_2N—CHMe\text{-}CH_2—(O—CH_2—CHMe)_y\text{-}(O—CH_2CH_2)_z—(O—CH_2—CHMe)_x\text{-}NH_2 \quad (III)$$

wherein R' is $C_1$-$C_6$ alkyl; x is an integer from 1 to 50; z is an integer from 1 to 20; and y is an integer from 0 to 10.

26. The composition of claim 24, wherein the polyetheramine has the formula:

$$H_2N—CHMe\text{-}CH_2—(O—CH_2—CHMe)_p\text{-}(O—CH_2CH_2)_Q—(O—CH_2—CHMe)_t\text{-}NH_2$$

wherein $_Q$ is an integer from 5 to 20; and p and t are integers from 0 to 10.

27. The composition of claim 24, wherein the polyetheramine has the formula:

$$R'—(O—CH_2CH_2)_z—(O—CH_2—CHMe)_y\text{-}NH_2 \quad (II)$$

wherein R' is $C_1$-$C_6$ alkyl; z on average is about 3 to 10 and y on average is about 20 to 50 and the polyetheramine has an average molecular weight of about 1,000 to 3,000.

28. The composition of claim 24, wherein the polyetheramine has formula:

$$H_2N—CHMe\text{-}CH_2—(O—CH_2—CHMe)_x\text{-}NH_2 \quad (I)$$

wherein is an integer and the polyetheramine has an average value for x of about 2 to 5; and the polyetheramine has an average molecular weight of about 200 to 300.

29. The composition of claim 24, further comprising a co-hardening agent, which includes a low vapor pressure, high flash point hydrocarbon or hydrocarbon mixture.

30. The composition of claim 24, wherein the composition is a gel having a gel melt temperature of about 50-80° C.

31. The composition of claim 24, wherein the adhesion promoter comprises ethoxylated $C_{14}$-$C_{22}$ alcohol having an average of 15 to 50 ethylene oxide units and an ethyleneoxide-propyleneoxide block copolymer.

32. The composition of claim 24, further comprising one or more of polyethylene glycol, mineral oil and polyol humectant.

33. The composition of claim 24, wherein the polyetheramine represented by the formula:

$$R''—(O—CH_2CH_2)_z—(O—CH_2—CHR)_x—NH_2$$

wherein R" is $C_1$-$C_6$ alkyl; z on average is about 3 to 10 and x on average is about 20 to 50 and the polyetheramine has an average molecular weight of about 1,000 to 3,000.

34. The composition of claim 24, wherein the polyetheramine has formula:

$$H_2N—CHMe\text{-}CH_2—(O—CH_2—CHMe)_x\text{-}NH_2$$

wherein is an integer and the polyetheramine has an average value for x of about 2 to 5; and the polyetheramine has an average molecular weight of about 200 to 300.

35. The composition of claim 24, wherein the composition comprises:

about 20 to 35 wt. % of an ethoxylated $C_{16}$-$C_{18}$ alcohol having an average of 15 to 35 ethylene oxide units;

about 1 to 5 wt. % of an ethoxylated $C_{10}$-$C_{15}$ alcohol having an average of 2 to 15 ethylene oxide units;

about 0.5 to 5 wt. % of the polyetheramine;

zero to about 5 wt. % polyethylene glycol;

about 0.1 to 2 wt. % mineral oil;

about 2 to 10 wt. % glycerin;

about 0.1 to 2 wt. % hydrophilic polyacrylate;

about 2 to 10 wt. % of a fragrance component; and at least about 40 wt. % water.

36. The composition of claim 24, wherein the alkoxylated alcohol comprises ethoxylated $C_{14}$-$C_{22}$ fatty alcohol and the polymeric alkylene oxide block copolymer comprises ethyleneoxide-propyleneoxide block copolymer.

37. A composition for treating a hard surface comprising (a) adhesion promoter, which comprises alkoxylated alcohol, alkoxylated polyol partial ester, polyethylene glycol and/or polymeric alkylene oxide block copolymer;

(b) at least one nonionic surfactant; wherein one or more of the at least one nonionic surfactant can serve all or in part as the adhesion promoter;

(c) polyetheramine; and (d) at least about 40 wt. % water;

wherein the composition is a gel, which is self-adhering upon application to a hard surface and has a gel melt temperature of about 50-90° C. and a viscosity at 25° C. of at least 300,000 cP; and the composition comprises about 15 to 40 wt. % ethoxylated $C_{12}$-$C_{30}$ fatty alcohol; and an equilibrated mixture of 10 wt. % of the compostition with deionized water has a pH of at least about 10.

38. The composition of claim 37, wherein the polyetheramine is represented by a formula (I), (II), (III) and/or (IV):

$$H_2N—CHMe-CH_2—(O—CH_2—CHMe)_x-NH_2 \quad (I)$$

$$R''—(O—CH_2CH_2)_z—(O—CH_2—CHR)_x—NH_2 \quad (II)$$

$$R''—(O—CH_2CH_2)_z—(O—CH_2—CHMe)_x-NH_2 \quad \text{(III) and/or}$$

$$H_2N—CHMe-CH_2—(O—CH_2—CHMe)_y-(O—CH_2CH_2)_z—(O—CH_2—CHMe)_x-NH_2 \quad (IV)$$

wherein R is H or Me; R" is $C_1$-$C_6$ alkyl; x is an integer from 1 to 50; z is an integer from 1 to 20; and y is an integer from 0 to 10.

39. The composition of claim 38, wherein the gel has a gel yield point hardness of at least about 2,500 Pa and a gel melt temperature of about 50-80° C.

40. The composition of claim 38, wherein the composition is a gel having viscosity at 80° C. of no more than about 250 cP.

41. The composition of claim 38, wherein the composition comprises less than about 0.1 wt. % cationic surfactants.

42. The composition of claim 38, wherein the composition comprises less than about 0.1 wt. % anionic surfactants.

43. The composition of claim 24, wherein the composition is a gel having viscosity at 80° C. of no more than about 250 cP.

44. The composition of claim 24, wherein the composition comprises less than about 0.1 wt. % cationic surfactants.

45. The composition of claim 24, wherein the composition comprises less than about 0.1 wt. % anionic surfactants.

* * * * *